US005188027A

United States Patent [19]

Fantoni

[11] Patent Number: 5,188,027

[45] Date of Patent: Feb. 23, 1993

[54] PRINTING APPARATUS WITH QUICKLY CHANGEABLE PRINTING PLATE

[75] Inventor: Giuseppe Fantoni, Ozzano, Italy

[73] Assignee: Office Meccaniche G. Cerutti S.p.A., Casale Monferrato, Italy

[21] Appl. No.: 545,477

[22] Filed: Jun. 28, 1990

[30] Foreign Application Priority Data

Jun. 30, 1989 [IT] Italy ..... 21044 A/89

[51] Int. Cl.[5] ..... B41F 5/00

[52] U.S. Cl. ..... 101/216; 101/153; 101/141; 101/174; 101/375

[58] Field of Search ..... 101/216, 217, 152, 153, 101/174, 141, 142, 375, 376, 477

[56] References Cited

U.S. PATENT DOCUMENTS

| | | | |
|---|---|---|---|
| 2,873,672 | 2/1959 | Säuberlich | 101/216 |
| 3,174,724 | 3/1965 | Verlik | 101/178 |
| 3,613,578 | 10/1971 | Heurich | 101/350 |
| 4,807,527 | 2/1989 | Knauer | 101/216 |
| 4,823,693 | 4/1989 | Köbler | 101/375 X |

*Primary Examiner*—David A. Wiecking
*Assistant Examiner*—Christopher A. Bennett
*Attorney, Agent, or Firm*—Ladas & Parry

[57] ABSTRACT

Printing apparatus with quickly changeable printing plate, the impression cylinder being mounted on the drive side of the machine and the remaining end of the impression cylinder being arranged to be freely floating in order to permit an unhindered attaching or fitting of the printing plate on the cylinder.

3 Claims, 4 Drawing Sheets

PRINTING APPARATUS WITH QUICKLY CHANGEABLE PRINTING PLATE

The present invention relates to a printing apparatus which makes it possible to exchange a cylindrical printing plate quickly without having to remove the entire impression cylinder or the cylinder receiving shaft from the apparatus.

An ever greater quality is demanded for printed products in particular when printing on narrow strips, such as for example labels, blanks for cigarette packs or similar blanks for the packaging industry which are produced, for example, by means of gravure processes or in the production of commercial prints, such as catalogues or brochures, which are often produced in a very small edition, for example using flexographic printing processes. The machine downtimes when changing over the machine are to be reduced to a minimum. At the same time, it must be possible to print even small editions of the widest variety in a cost-effective way. Even today this demands a frequent exchange of the impression cylinders, a fact which leads to considerable downtimes of the machine.

It is the object of the present invention to avoid the disadvantages of the prior art and to propose a printing apparatus with which a simple and quick exchange of the printing plate is possible. The object is achieved according to the invention by the fact that the impression cylinder is rotatably mounted on the drive side of the machine and the free end of the impression cylinder is arranged to be suspended from the ground in order to permit an unhindered attaching or a simple fitting of a cylindrical printing plate.

The rotatable mounting of the impression cylinder at only one end makes it possible to draw cylindrical printing plates onto the impression cylinder in a simple and quick way. The printing plates can thus be exchanged quickly and simply and are clamped on the impression cylinder using known cylinders variable in their diameter.

There is also the possibility of making the change of the printing plates automatic.

Further features of the invention can be taken from the following description, the subclaims and the attached drawings.

The subject of the invention is now described in more detail with reference to a number of exemplary embodiments and is represented diagrammatically in the drawings, in which.

Figure 1:
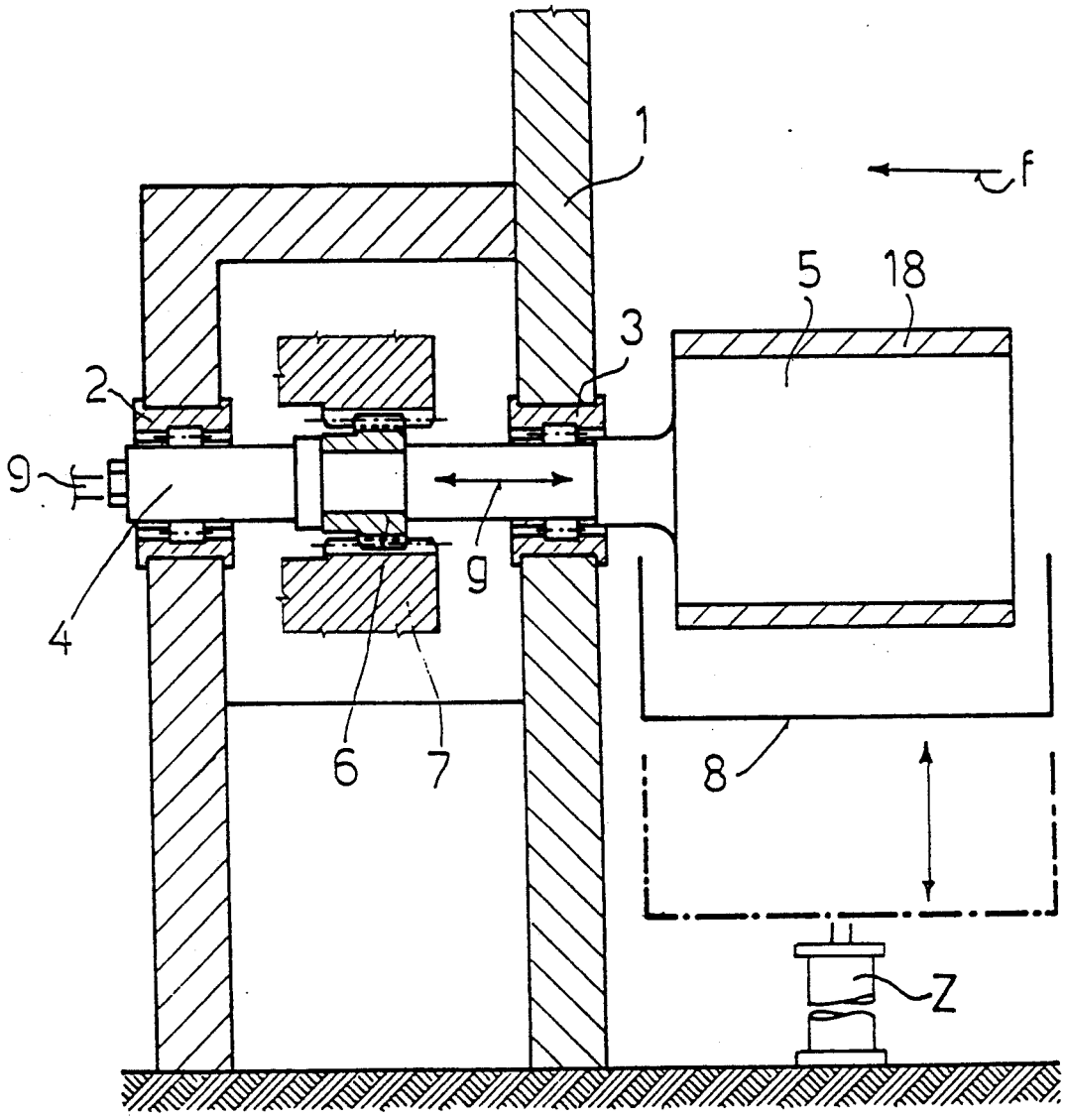
FIG. 1 shows an impression cylinder which is mounted so as to be freely floating with respect to the printing apparatus.

As FIG. 1 reveals, the frame 1 of the printing machine has a mounting, for example in the form of rolling bearings 2 and 3 which are fitted in the machine frame 1, only on one side. The bearings 2 and 3 receive an extension in the form of a shaft 4 projecting from the impression cylinder 5. The shaft 4 is in effective connection with a gear wheel 6, which is driven by known driving means of the printing machine.

As FIG. 1 also reveals, that impression cylinder 5, mounted on the frame so as to be suspended from the ground, is suitable for receiving a cylindrical printing plate 18. The printing plate 18 is drawn onto the impression cylinder 5 from the end face of the latter, as represented by the arrow f. The cylindrical printing plate 18 is fixed on the impression cylinder 5 by the provision of known clamping devices. The impression cylinders 5 are, for example, variable in their diameter in order thereby to clamp the printing plate.

As revealed by FIG. 1, the cylindrically designed printing plate 18 can be slid onto or slid off the impression cylinder 5 in an unhindered manner since when the printing plate is drawn off from or drawn onto the impression cylinder 5, impression cylinder 5 is supported above the ground in a cantilever-like manner with only one end of the impression cylinder being supported by shaft 4, and since inking device 8 is arranged displaceably with respect to the cylinder 5. In the exemplary embodiment according to FIG. 1, this is performed using a raising and lowering device, for example a hydraulic piston-cylinder unit Z, which is connected to the inking device so that the inking device can be raised and lowered with respect to the impression cylinder. If the inking device 8 is in the lowered positions (represented by dot-dashed lines), it can be seen that in this case the impression cylinder 5 has a completely accessible end and as a result, a quick fitting or detaching of the printing plate 18 on the cylinder 5 is possible. This arrangement has proved particularly advantageous in small print runs.

Apart from a lifting and lowering movement, the inking device 8 can also be moved away from the printing apparatus 1. For this purpose, it is sufficient for the inking device 8 to be designed as a carriage. This possibility simplifies the usual cleaning and maintenance work on the moved-out inking device 8.

Figure 2:
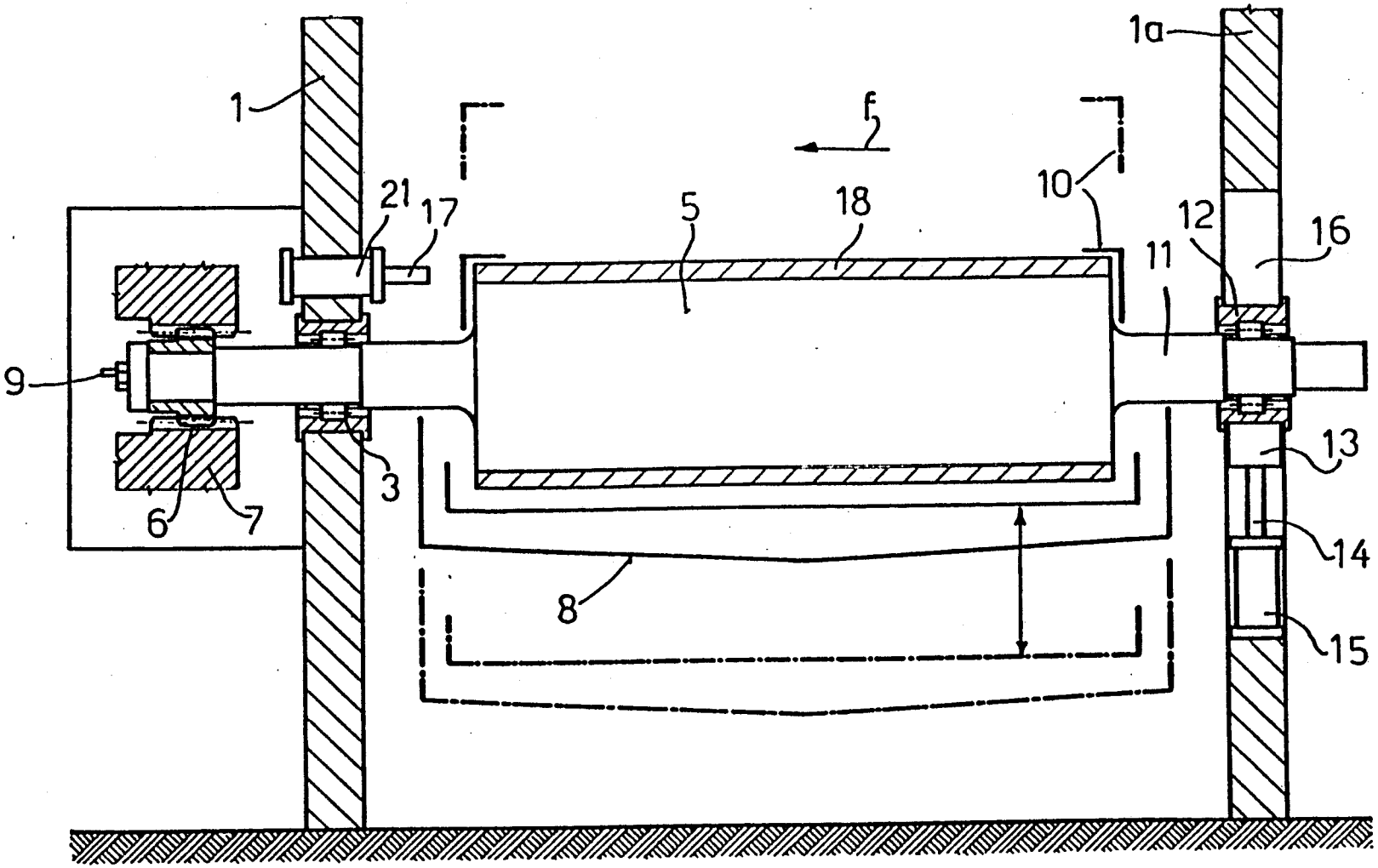
FIG. 2 shows an impression cylinder of a longer design which is mounted on one side of the apparatus and is supported at its other end by an auxiliary apparatus.

The shaft 4 which projects from the cylinder 5 is assigned on the bearing side (2, 3) a device known from the prior art for in-register setting of the cylinder 5 in the axial direction, i.e. in the direction of the arrow g. Since this setting device is generally known, a precise description has not been included. In order to admit a pressure medium to the impression cylinder 5 and, by varying the cylinder diameter, carry out a clamping of the cylindrical printing plate on the cylinder 5, the end of the shaft 4 has a connection piece 9, via which a pressure medium can be introduced into the interior of the impression cylinder 5. The pressure medium causes the cylinder 5 to expand and, as a result, clamp the cylindrical printing plate 18. A further exemplary embodiment of an impression cylinder 5 is represented in FIG. 2. This impression cylinder 5 is also freely accessible through sidewall 1*a* in order to permit a simple attaching or drawing off of the printing plate 18.

In the case of this exemplary embodiment, the cylinder 5 is also assigned splash guards 10, which are provided on the ends of the cylinder 5 and can be displaced from a position represented by solid lines into a position represented by dot-dashed lines.

As FIG. 2 also reveals, the cylinder 5 represented has a second shaft 11 in the form of a projecting hub, which is fitted with a rolling bearing 12. In order to avoid this hub or shaft 11 tending to oscillate or vibrate under the rotary drive of the cylinder 5 on account of the greater overall length of the cylinder 5, the rolling bearing 12 advantageously rests on a bearing plate 13 which is in effective connection with the rod 14 of a hydraulic piston 15 or a similar lifting means.

If a printing plate 18 on the impression cylinder 5 is to be exchanged, it is necessary to free the opening 16 in the side wall la of the machine frame. All that is needed to do so is to lower the bearing plate 13 while the impression cylinder 5 is at a standstill by actuating the piston 15. As a result, the opening 16 is free for an unhindered introduction of a new printing plate 18 and a quick fitting of the printing plate 18 in the direction of the arrow f becomes possible.

Of course, the splash guards 10 are also raised with the assistance of pneumatic or hydraulic actuating means in order to be moved into the position represented by dot-dashed lines. The inking device 8 is also displaced into the moved-down position represented by dot-dashed lines.

It has proved to be extremely helpful to arrange in the wall 1 of the machine frame a cylinder 21 of which the piston rod 17 acts on the end face of the printing plate 18 when there is heavy caking (caused by the inking), in order to dislodge this from the impression cylinder 5 and thereby make it easier to draw off the printing plate 18.

Figure 3:
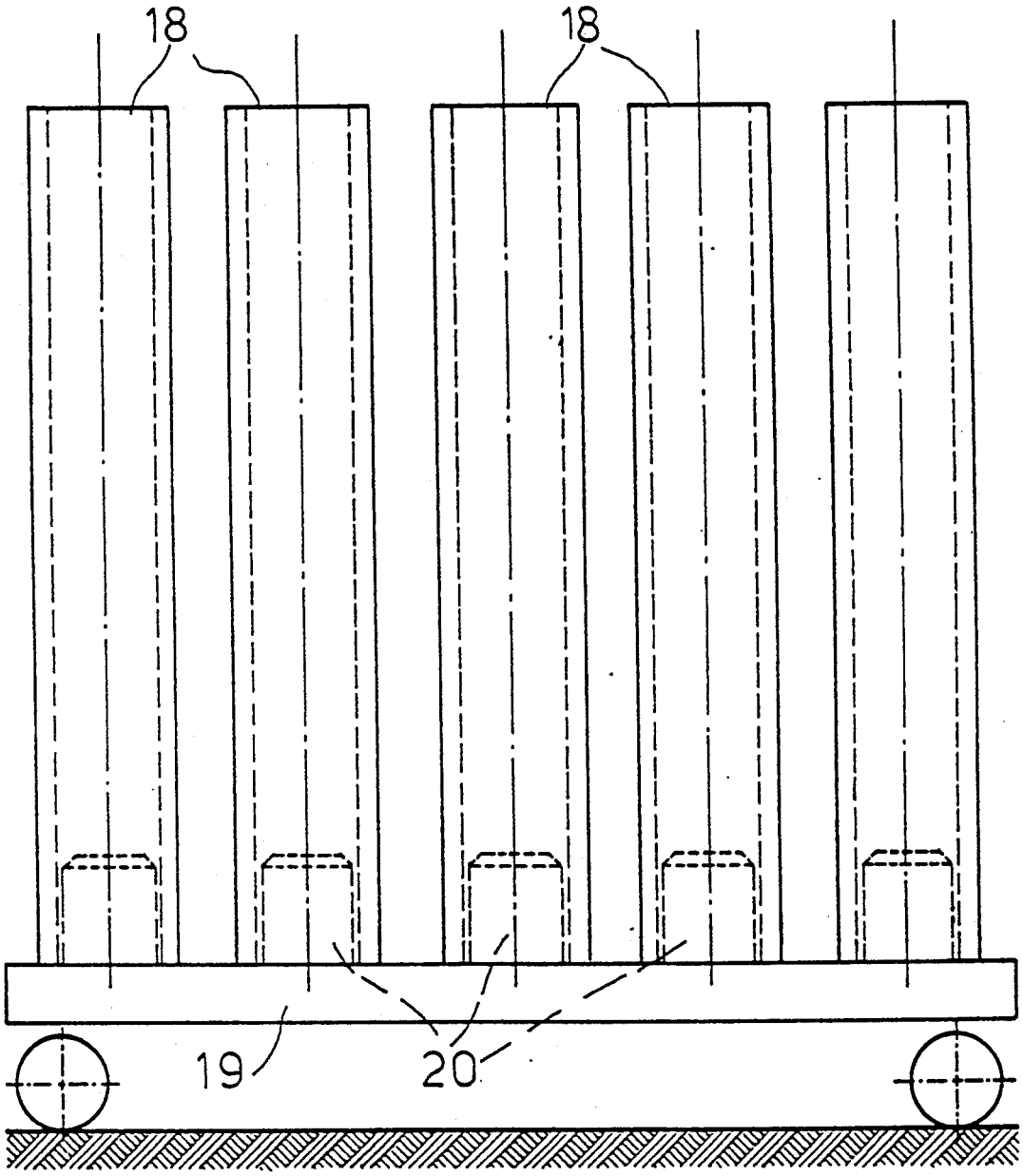
FIG. 3 shows a view of a carriage for the transporting of tubular printing plates.

In order to permit quick and simple exchanging of the printing plates 18, it is advantageous to provide a carriage 19 for the feeding and storage of the printing plates 18 according to FIG. 3. This carriage 19 has a series of elevations 20. The printing plates 18 can be fitted onto these projections 20 in an upright position.

Consequently, by use of a carriage 19, the printing plates 18 are transported into the vicinity of the apparatus for the cylinder 5 of which a tubular printing plate 18 is about to be exchanged. After the printing plate 18 has been drawn off the corresponding cylinder 5, the no longer required printing plate is fitted onto the free projection 20 of the carriage, after which a new printing plate 18 is taken from the carriage 19 in order to be drawn onto the exposed impression cylinder 5. After in-register positional arrangement of the printing plate 18 on the cylinder, once again a clamping of the printing plate 18 on the cylinder 5 is carried out and the printing apparatus is available for new printing operations.

Figure 4:
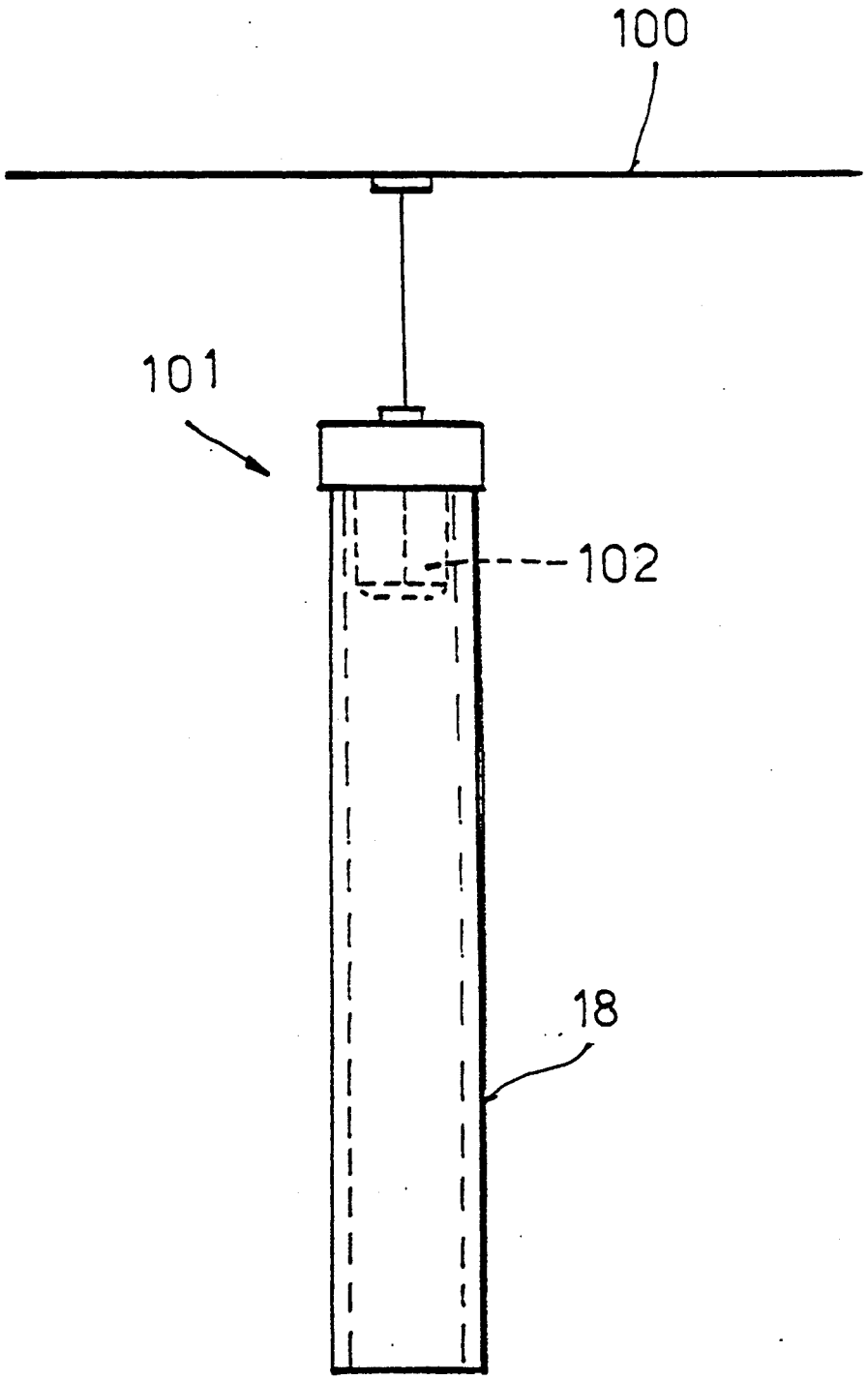
FIG. 4 shows a diagrammatic view of a cableway for feeding the printing plates.

A further transporting device 101 for the transporting of the printing plates 18 is represented in FIG. 4. This device 101 consists essentially of an overhead conveyor line or conveyor chain 100, which spans the distance from the store for the printing plates 18 to the printing machine 1. The holding device 101 has peg-like holders 102, which can be spread apart and make it possible to hold the printing plate during the transporting movement and to release the printing plate 18 only when in the vicinity of the printing apparatus. Of course, the holding device may also be designed in the manner of a yoke and have a plurality of holders 102 for a plurality of printing plates 18.

I claim:

1. A printing apparatus comprising:

a frame including first and second opposed and spaced side walls;

roller bearings mounted in each said side wall;

an impression cylinder having opposite ends and bearing shaft extending from only one end thereof, said bearing shaft being rotatably mounted in said roller bearings to support said impression cylinder in a projecting cantilever-like manner from one of said side walls of said frame with the other of said ends of the impression cylinder completely free and open to permit a printing plate to be mounted and dismounted from said impression cylinder by sliding said printing plate over said other end of the impression cylinder; and drive means disposed between said side walls of said frame in driving engagement with said bearing shaft for driving said impression cylinder in rotation.

2. A printing apparatus according to claim 1, further comprising an inking means and means engageable with said inking means so that said inking means is movable between a first position in which the inking means is in fluid communication with said printing plate and a second position in which the inking means is spaced from the impression cylinder to allow the printing plate to be mounted and dismounted.

3. A printing apparatus according to claim 1, further comprising a pushing means on said frame, adjacent to said one end of said impression cylinder, which is engageable with said printing plate to dislodge the printing plate from said impression cylinder.

* * * * *